US006565493B1

(12) United States Patent
Geh

(10) Patent No.: US 6,565,493 B1
(45) Date of Patent: May 20, 2003

(54) ARM MUSCLE DEVELOPING DEVICE

(76) Inventor: Archiri F. Geh, 100 E. Hillcrest Blvd., Suite 5A, Los Angeles, CA (US) 90301

( * ) Notice: Subject to any disclaimer, the term of this patent is extended or adjusted under 35 U.S.C. 154(b) by 155 days.

(21) Appl. No.: 09/881,961

(22) Filed: Jun. 15, 2001

(51) Int. Cl.[7] ..... A63B 21/02

(52) U.S. Cl. ..... 482/122; 482/121; 482/124; 601/33

(58) Field of Search ..... D21/684, 692, D21/693; 601/33; 482/44–46, 121, 122, 124, 128, 148, 908

(56) References Cited

U.S. PATENT DOCUMENTS 4,214,577 A * 7/1980 Hoy ..... 601/33
4,310,154 A 1/1982 Kauffman
4,606,542 A * 8/1986 Segal ..... 482/124
5,042,799 A 8/1991 Stanley
5,100,126 A 3/1992 Liou
5,271,617 A * 12/1993 Gilford ..... 473/450
5,425,690 A 6/1995 Chang
D361,809 S 8/1995 Huang
5,454,769 A 10/1995 Chen
5,662,595 A * 9/1997 Chesher et al. ..... 602/20

* cited by examiner

*Primary Examiner*—Nicholas D. Lucchesi
*Assistant Examiner*—Tam Nguyen

(57) ABSTRACT

An arm muscle developing device for selectively exercising the triceps or biceps of the arm. The device includes a substantially rigid panel having a first surface, a second surface, a first end, a second end, a first side edge, and a second side edge. A frame includes a first elongate member, a second elongate member, a third elongate member and a fourth elongate member. The first and second elongate members are orientated parallel to each other. The third elongate member is hingedly coupled to the first end of the panel. A first securing member removably secures the upper portion of the arm to the panel. A second securing member removably secures the lower arm. Each of a plurality of loop members is attached to the frame and the panel. A plurality of biasing members bias the loop members attached to the frame toward the loop members attached to the panel.

8 Claims, 3 Drawing Sheets

26
22
10
40
27
62
30
19
20
62
13
64
66
62
12

ARM MUSCLE DEVELOPING DEVICE

BACKGROUND OF THE INVENTION

1. Field of the Invention

The present invention relates to exercise devices and more particularly pertains to a new arm muscle developing device for selectively exercising the triceps or biceps of the arm.

2. Description of the Prior Art

The use of exercise devices is known in the prior art. More specifically, exercise devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 5,100,126; 5,454,769; 5,042,799; 5,425,690; 4,310,154; and 361,809.

While these devices fulfill their respective, particular objectives and requirements, the aforementioned patents do not disclose a new arm muscle developing device. The inventive device includes a substantially rigid panel having a first surface, a second surface, a first end, a second end, a first side edge, and a second side edge. A frame includes a first elongate member, a second elongate member, a third elongate member and a fourth elongate member. The frame has a generally rectangular configuration such that the first and second elongate members are orientated parallel to each other. The third elongate member is hingedly coupled to the first end of the panel. A first securing member for removably securing the upper portion of the arm to the panel is attached to the panel. A second securing member for removably securing the lower arm of the arm to the frame is attached to the frame. A plurality of loop members each is attached to the frame and the panel. A plurality of biasing members bias the loop members attached to the frame toward the loop members attached to the panel and are removably attachable to the loop members.

In these respects, the arm muscle developing device according to the present invention substantially departs from the conventional concepts and designs of the prior art, and in so doing provides an apparatus primarily developed for the purpose of selectively exercising the triceps or biceps of the arm.

SUMMARY OF THE INVENTION

In view of the foregoing disadvantages inherent in the known types of exercise devices now present in the prior art, the present invention provides a new arm muscle developing device construction wherein the same can be utilized for selectively exercising the triceps or biceps of the arm.

The general purpose of the present invention, which will be described subsequently in greater detail, is to provide a new arm muscle developing device apparatus and method which has many of the advantages of the exercise devices mentioned heretofore and many novel features that result in a new arm muscle developing device which is not anticipated, rendered obvious, suggested, or even implied by any of the prior art exercise devices, either alone or in any combination thereof.

To attain this, the present invention generally comprises a substantially rigid panel having a first surface, a second surface, a first end, a second end, a first side edge, and a second side edge. A frame includes a first elongate member, a second elongate member, a third elongate member and a fourth elongate member. The frame has a generally rectangular configuration such that the first and second elongate members are orientated parallel to each other. The third elongate member is hingedly coupled to the first end of the panel. A first securing member for removably securing the upper portion of the arm to the panel is attached to the panel. A second securing member for removably securing the lower arm of the arm to the frame is attached to the frame. A plurality of loop members each is attached to the frame and the panel. A plurality of biasing members bias the loop members attached to the frame toward the loop members attached to the panel and are removably attachable to the loop members.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new arm muscle developing device apparatus and method which has many of the advantages of the exercise devices mentioned heretofore and many novel features that result in a new arm muscle developing device which is not anticipated, rendered obvious, suggested, or even implied by any of the prior art exercise devices, either alone or in any combination thereof.

It is another object of the present invention to provide a new arm muscle developing device which may be easily and efficiently manufactured and marketed.

It is a further object of the present invention to provide a new arm muscle developing device which is of a durable and reliable construction.

An even further object of the present invention is to provide a new arm muscle developing device which is susceptible of a low cost of manufacture with regard to both materials and labor, and which accordingly is then susceptible of low prices of sale to the consuming public, thereby making such arm muscle developing device economically available to the buying public.

Still yet another object of the present invention is to provide a new arm muscle developing device which provides in the apparatuses and methods of the prior art some of the advantages thereof, while simultaneously overcoming some of the disadvantages normally associated therewith.

Still another object of the present invention is to provide a new arm muscle developing device for selectively exercising the triceps or biceps of the arm.

Yet another object of the present invention is to provide a new arm muscle developing device which includes a substantially rigid panel having a first surface, a second surface, a first end, a second end, a first side edge, and a second side edge. A frame includes a first elongate member, a second elongate member, a third elongate member and a fourth elongate member. The frame has a generally rectangular configuration such that the first and second elongate members are orientated parallel to each other. The third elongate member is hingedly coupled to the first end of the panel. A first securing member for removably securing the upper portion of the arm to the panel is attached to the panel. A second securing member for removably securing the lower arm of the arm to the frame is attached to the frame. A plurality of loop members each is attached to the frame and the panel. A plurality of biasing members bias the loop members attached to the frame toward the loop members attached to the panel and are removably attachable to the loop members.

Still yet another object of the present invention is to provide a new arm muscle developing device that has removable springs for changing the difficulty of the moving the frame with relation to the panel.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
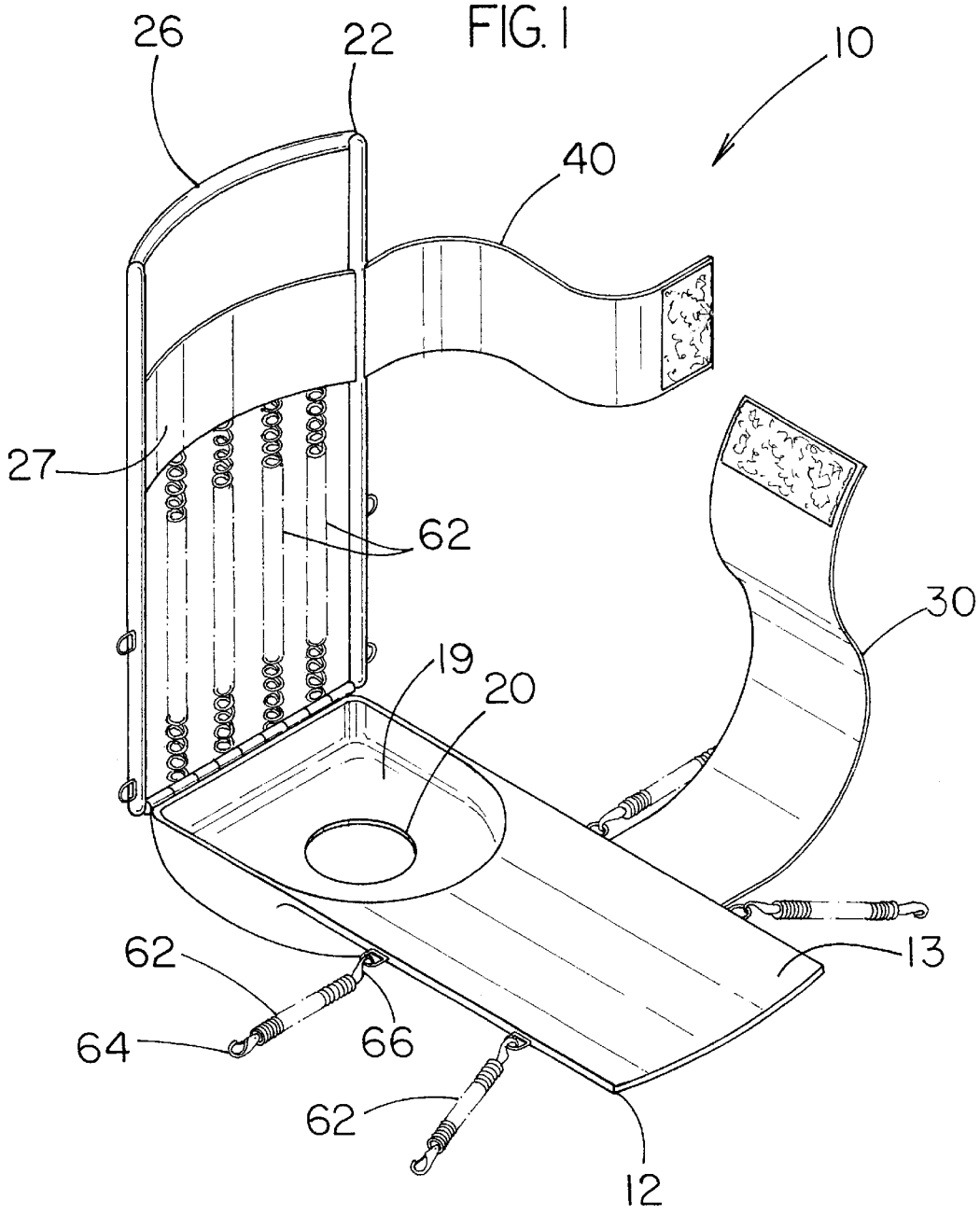
FIG. 1 is a schematic perspective view of a new arm muscle developing device according to the present invention.
Figure 2:
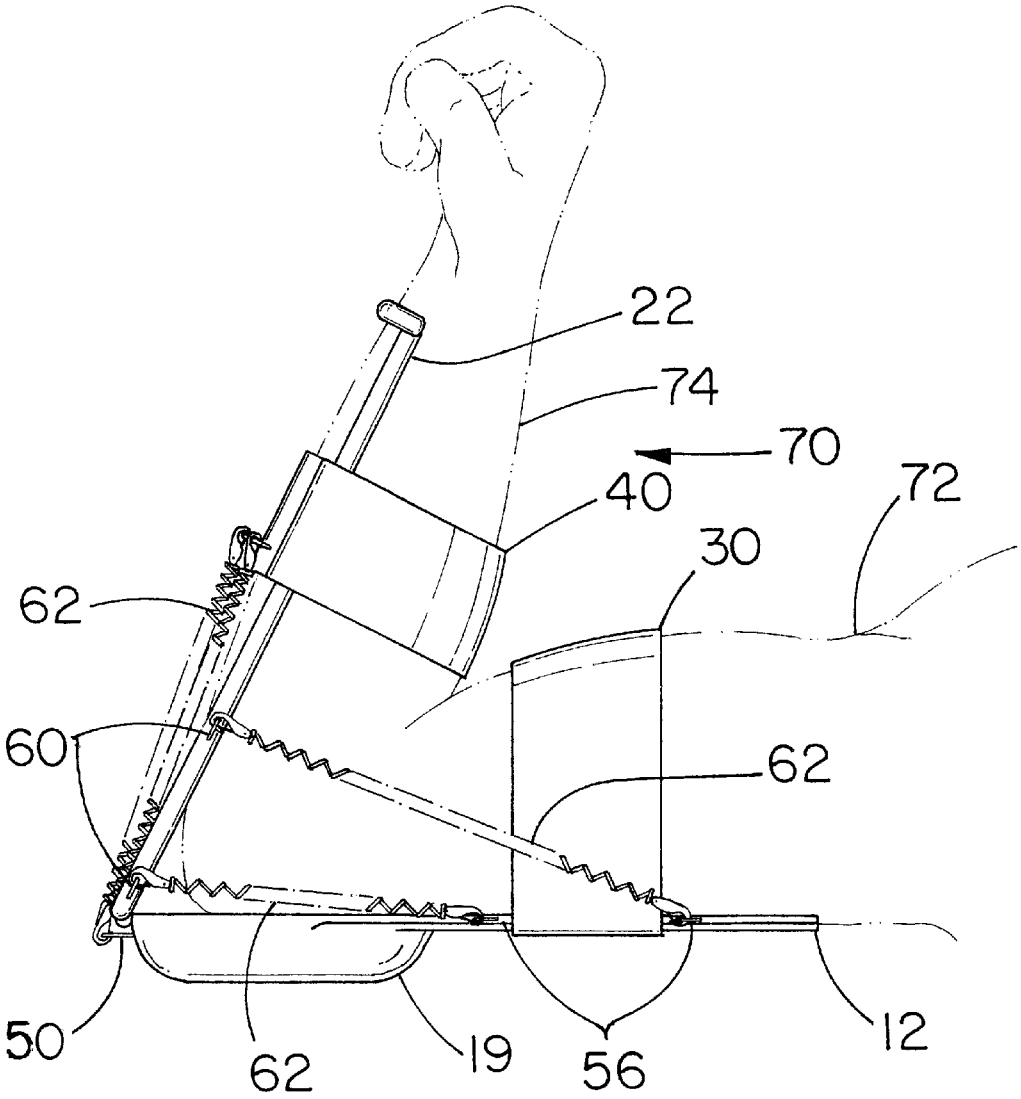
FIG. 2 is a schematic side view of the present invention.
Figure 3:
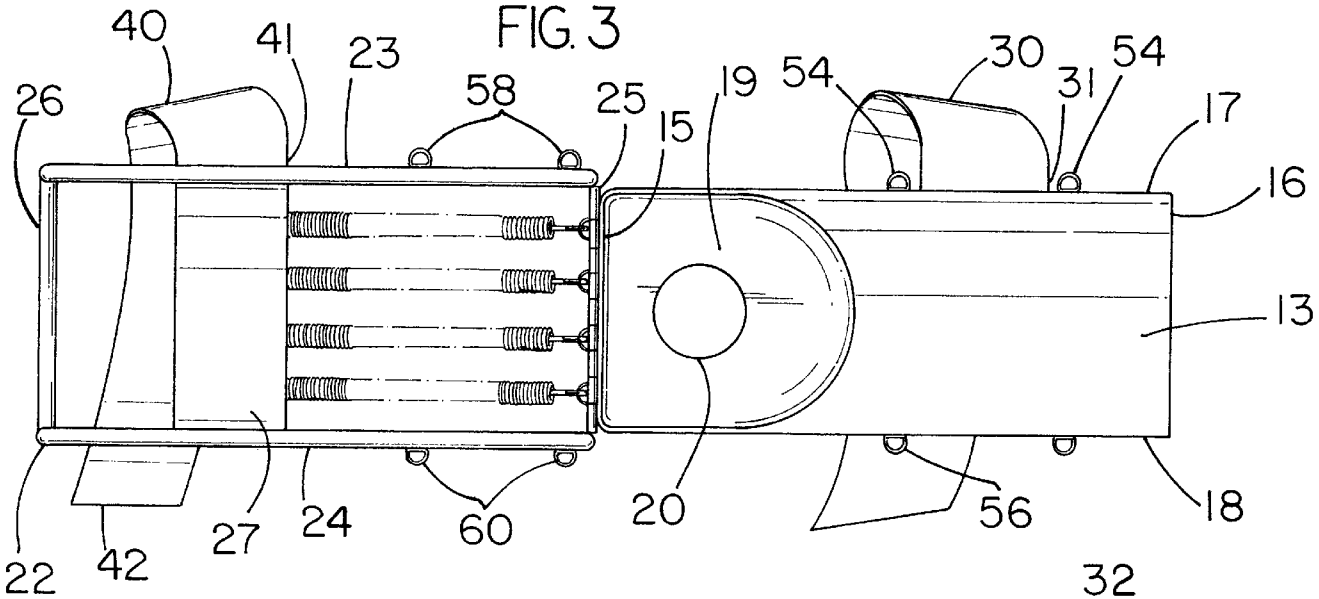
FIG. 3 is a schematic top view of the present invention.
Figure 4:
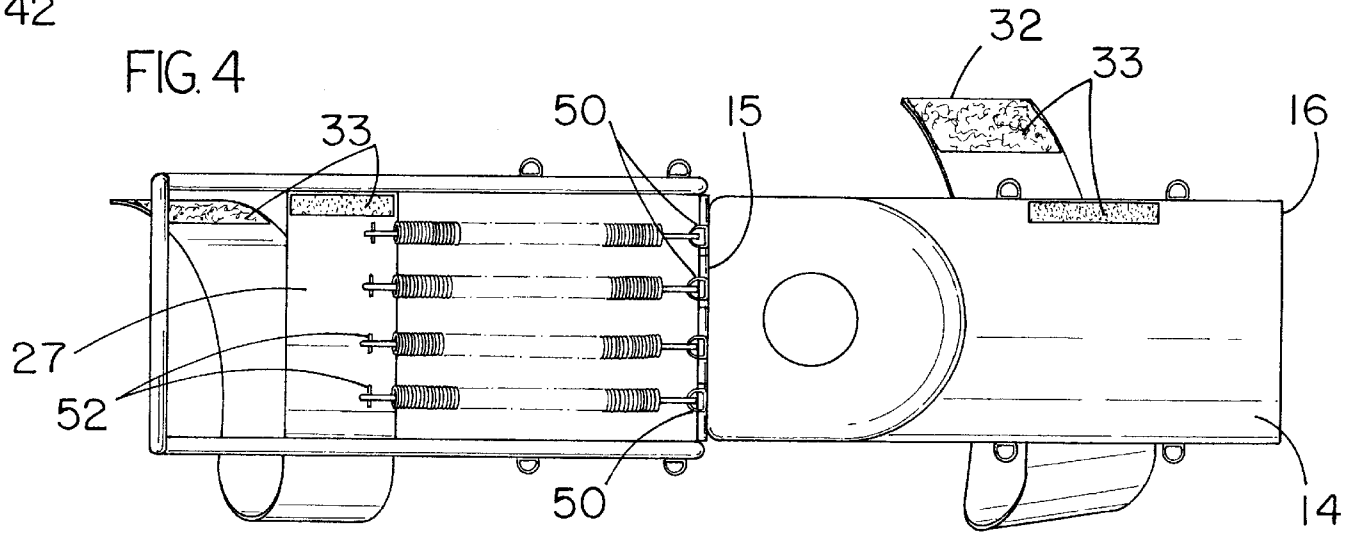
FIG. 4 is a schematic bottom view of the present invention.

With reference now to the drawings, and in particular to FIGS. 1 through 4 thereof, a new arm muscle developing device embodying the principles and concepts of the present invention and generally designated by the reference numeral 10 will be described.

As best illustrated in FIGS. 1 through 4, the arm muscle developing device 10 generally comprises a substantially rigid panel 12 having a first surface 13, a second surface 14, a first end 15, a second end 16, a first side edge 17, and a second side edge 18. The panel 12 is arcuate from the first side edge 17 to the second side edge 18 such that the first surface 13 extends inward and the second surface 14 extends outward. The first surface 13 has a depression 19 therein positioned adjacent to the first end 15 that extends between the first 17 and second 18 side edges. The depression 19 has a generally centrally located opening 20 therein extending through the first 13 and second 14 surfaces.

A frame 22 includes a first elongate member 23, a second elongate member 24, a third elongate member 25 and a fourth elongate member 26. The frame 22 has a generally rectangular configuration such that the first 23 and second 24 elongate members are orientated parallel to each other. The third elongate member 25 is hingedly coupled to the first end 15 of the panel 12. The fourth elongate member 26 is arcuate and extends in the same direction as the depression 19 when the first 23 and second 24 elongate members are orientated generally parallel to the first 17 and second 18 side edges. A plate 27 extends between the third 25 and fourth 26 elongate members. The plate 27 is preferably arcuate and extends outwardly in the same direction as the fourth elongate member 26.

A first securing member 30 removably secures the upper portion 72 of an arm 70 to the panel 12. The first securing member 30 comprises a first strap having a first end 31 attached to the first side edge 17 of the panel 12. A fastening means 33 removably fastens a second end 32 of the first strap 30 to the second surface 14 adjacent to the second side edge 18. The fastening means 33 preferably comprises hook and loop fastening means, though snaps may be used instead.

A second securing member 40 removably secures the lower arm 74 to the frame 22. The second securing member 40 comprises second strap having a first end 41 attached to the first elongate member 23. A fastening means 33 removably fastens a second end 42 of the second strap 40 to the plate 27 and preferably comprises a hook and loop fastening means.

Each of plurality of loop members is attached to either the panel 12 or the frame 22. A first set of loop members 50 is attached to the second surface 14 of the depression 19. A second set of loop members 52 is attached to the plate 27. A third set of loop members 54 is attached to the first side edge 17. A fourth set of loop members 56 is attached to the second side edge 18. A fifth set of loop members 58 is attached to the first elongate member 23. A sixth set of loop members 60 is attached to the second elongate member 23.

A plurality of biasing members 62 bias the loop members attached to the frame 22 toward the loop members attached to the panel 12. Each of the biasing members 62 comprises a spring having a first end 64 and a second end 66. Each of the first 64 and second ends 66 of the springs forms a hook removably attachable to one of the loop members.

In use, the elbow is positioned in the opening 20 and the securing members 30, 40 extended around the arm 70 of the user to hold the arm to the device. The springs 60 may be coupled to and extended between the first 50 and second 52 set of loop members for exercising the biceps of the arm. The springs may be coupled to and extended between the third 54 and fifth 58 loop members and between the fourth 56 and sixth 60 loop members for exercising the triceps of the arm. The device is either extended in length or contracted depending on the exercise performed to place stress on the springs 60.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An arm muscle developing device comprising:

a substantially rigid panel having a first surface, a second surface, a first end, a second end, a first side edge, and a second side edge;

a frame including a first elongate member, a second elongate member, a third elongate member and a fourth elongate member, said frame having a generally rectangular configuration such that said first and second elongate members are orientated parallel to each other, said third elongate member being hingedly coupled to said first end of said panel;

a first securing member for removably securing the upper portion of the arm to said panel being attached to said panel;

a second securing member for removably securing the lower arm of the arm to said frame being attached to said frame;

a plurality of loop members each being attached to said frame and said panel; and a plurality of biasing members for biasing said loop members attached to said frame toward said loop members attached to said panel, each of said biasing members comprising having first end and a second end, each of said first and second ends being removably attachable to one of said loops members such that said biasing members extend between said panel and said frame.

2. The arm muscle developing device as in claim 1, wherein said panel is arcuate from said first side edge to said second side edge such that said first surface extends inward.

3. The arm muscle developing device as in claim 1, wherein said first surface has a depression therein positioned adjacent to said first end and extending between said first and second side edges.

4. The arm muscle developing device as in claim 3, wherein said depression has a generally centrally located opening therein extending through said first and second surfaces.

5. The arm muscle developing device as in claim 3, wherein said fourth elongate member is arcuate and extends in the same direction as said depression when said first and second elongate members are orientated generally parallel to said first and second side edges.

6. The arm muscle developing device as in claim 1, wherein said first securing member comprises a first strap having a first end attached to said first side edge of said panel, a fastening means for removably fastening a second end of said first strap to said second surface adjacent to said second side edge, said second securing member comprising a second strap having a first end attached to said first elongate member, a fastening means for removably fastening a second end of said second strap to said first end of said second strap attached to said first elongate member.

7. The arm muscle developing device as in claim 1, wherein a first set of loop members is attached to said second surface of said depression, a second set of loop members being attached to a plate extending between said first and second elongate members, a third set of loop members being attached to said first side edge, a fourth set of loop members being attached to said second side edge, a fifth set of loop members being attached to said first elongate member, a sixth set of loop members being attached to said second elongate member, wherein said springs may be coupled to and extended between said first and second set of loop members for exercising the biceps of the arm, wherein said springs may be coupled to and extended between said third and fifth loop members and between said fourth and sixth loop members for exercising the triceps of the arm.

8. An arm muscle developing device comprising:

a substantially rigid panel having a first surface, a second surface, a first end, a second end, a first side edge, and a second side edge, said panel being arcuate from said first side edge to said second side edge such that said first surface extends inward, said first surface having a depression therein positioned adjacent to said first end and extending between said first and second side edges, said depression having a generally centrally located opening therein extending through said first and second surfaces;

a frame including a first elongate member, a second elongate member, a third elongate member and a fourth elongate member, said frame having a generally rectangular configuration such that said first and second elongate members are orientated parallel to each other, said third elongate member being hingedly coupled to said first end of said panel, said fourth elongate member being arcuate and extending in the same direction as said depression when said first and second elongate members are orientated generally parallel to said first and second side edges, a plate extends between the first and second elongate members;

a first securing member for removably securing the upper portion of the arm to said panel being attached to said panel, said first securing member comprising a first strap having a first end attached to said first side edge of said panel, a fastening means for removably fastening a second end of said first strap to said second surface adjacent to said second side edge, said fastening means comprising hook and loop fastening means;

a second securing member for removably securing the lower arm of the arm to said frame, said second securing member comprising a second strap having a first end attached to said first elongate member, a fastening means for removably fastening a second end of said second strap to said plate and comprising a hook and loop fastening means;

a plurality of loop members, a first set of loop members being attached to said second surface of said depression, a second set of loop members being attached to said plate, a third set of loop members being attached to said first side edge, a fourth set of loop members being attached to said second side edge, a fifth set of loop members being attached to said first elongate member, a sixth set of loop members being attached to said second elongate member; and a plurality of biasing members for biasing said loop members attached to said frame toward said loop members attached to said panel, each of said biasing members comprising a spring having first end and a second end, each of said first and second ends of said springs forming a hook, wherein said springs may be coupled to and extended between said first and second set of loop members for exercising the biceps of the arm, wherein said springs may be coupled to and extended between said third and fifth loop members and between said fourth and sixth loop members for exercising the triceps of the arm.

* * * * *

UNITED STATES PATENT AND TRADEMARK OFFICE

CERTIFICATE OF CORRECTION

PATENT NO. : 6,565,493 B1
DATED : May 20, 2003
INVENTOR(S) : Archiri F. Geh

It is certified that error appears in the above-identified patent and that said Letters Patent is hereby corrected as shown below:

Title page,
Item [76], Inventors address delete "100 E. Hillcrest Blvd., Suite 5A, Los Angeles, CA (US) 90301" and insert -- 4153 Jasmine Ave., Culver City, CA (US) 90232 --.

Signed and Sealed this

Ninth Day of September, 2003

JAMES E. ROGAN
*Director of the United States Patent and Trademark Office*